US008807366B2

(12) United States Patent
Erm

(10) Patent No.: US 8,807,366 B2
(45) Date of Patent: Aug. 19, 2014

(54) FOLDING ASSEMBLY BOX

(75) Inventor: Won Sun Erm, Seoul (KR)

(73) Assignee: Won Sun Erm, Seoul (KR)

( * ) Notice: Subject to any disclaimer, the term of this patent is extended or adjusted under 35 U.S.C. 154(b) by 0 days.

(21) Appl. No.: 13/806,341

(22) PCT Filed: Dec. 30, 2010

(86) PCT No.: PCT/KR2010/009597

§ 371 (c)(1),
(2), (4) Date: Dec. 21, 2012

(87) PCT Pub. No.: WO2011/162462

PCT Pub. Date: Dec. 29, 2011

(65) Prior Publication Data

US 2013/0092685 A1 Apr. 18, 2013

(30) Foreign Application Priority Data

Jun. 21, 2010 (KR) ..... 10-2010-0058534

(51) Int. Cl.
*B65D 6/16* (2006.01)

(52) U.S. Cl.
USPC ..... 220/6; 220/7; 220/666; 217/12 R; 217/16; 217/43 R

(58) Field of Classification Search
CPC .. B65D 7/26; B65D 11/1833; B65D 11/1853; B65D 19/12; B65D 7/24; B65D 9/14; B65D 9/22; B65D 9/38
USPC ..... 220/6, 7, 666, 668; 206/386, 577, 600; 217/12 R, 16, 43 A, 43 R
See application file for complete search history.

(56) References Cited

U.S. PATENT DOCUMENTS 3,989,157 A * 11/1976 Veenema ..... 220/4.28
4,673,087 A * 6/1987 Webb ..... 206/600

(Continued)

FOREIGN PATENT DOCUMENTS

DE 693 11 351 T2 1/1998
JP S64051025 3/1989

(Continued)

OTHER PUBLICATIONS

European Search Report for EP 10853745.7-1708 dated Feb. 26, 2014.

*Primary Examiner* — Fenn Mathew
*Assistant Examiner* — Madison L Poos
(74) *Attorney, Agent, or Firm* — Bacon & Thomas, PLLC

(57) ABSTRACT

A folding assembly box includes vertical corner hinge frames disposed in corners of the box, and vertical middle hinge frames disposed between the vertical corner hinge frames facing each other at both sides thereof. The vertical corner hinge frames are unfolded at an angle to form the respective corners of the box, and are hinged in the opposite direction to the direction where the vertical corner hinge frames are unfolded. The vertical middle hinge frames are unfolded together with the vertical corner hinge frames at both sides thereof, and hinged in the opposite direction to the opposite direction where the vertical corner hinge frames are unfolded. Top and bottom horizontal frames are disposed to connect upper and lower ends of the vertical corner hinge frames facing each other. Panels are inserted between the first top and bottom horizontal frames facing each other.

9 Claims, 12 Drawing Sheets

(56) References Cited

U.S. PATENT DOCUMENTS

| | | | | |
|---|---|---|---|---|
| 4,828,132 | A * | 5/1989 | Francis et al. | 220/6 |
| 5,971,187 | A * | 10/1999 | Clee et al. | 220/4.29 |
| 8,210,358 | B2 * | 7/2012 | Haddad et al. | 206/767 |

FOREIGN PATENT DOCUMENTS

| | | | |
|---|---|---|---|
| JP | U3056833 | | 12/1998 |
| JP | H11-116001 | | 4/1999 |
| JP | 2000079941 | | 3/2000 |
| JP | 2009023709 | | 2/2009 |
| KR | 200417505 | | 5/2006 |
| KR | 100627177 | B1 | 9/2006 |
| WO | 94/06692 | A1 | 3/1994 |
| WO | 96/28360 | A1 | 9/1996 |

* cited by examiner

FOLDING ASSEMBLY BOX

FIELD OF THE INVENTION

The present invention relates to a folding assembly box, and more particularly, to a folding assembly box of which the solidity is further improved while minimizing the volume thereof when the box is folded.

BACKGROUND

In general, a carrying box has a bottom portion coupled to a support member such as a palette so as to be carried by a forklift truck. The carrying box is integrated with a palette or formed to maintain the shape thereof as it is, and thus the carrying box inevitably occupies a large space when the carrying box is moved to be stored or collected.

In order to solve such a problem, a folding assembly box has been used, which may be folded to reduce the volume when stored or collected. For example, Korean Utility Model Registration No. 20-0417505, registered on May 23, 2006, discloses a folding container palette system.

FIGS. 1 and 2 illustrate a folding container palette system as an example of a folding assembly box. The folding container palette system includes a box 10, a palette 20, and a lid 30. The box 10 may be folded to reduce the volume when the folding container palette system is carried or stored.

The box 10 includes a plurality of plastic panels 11 and 12, four corner hinge supports 13, and two center hinge supports 14. The corner hinge supports 13 and the center hinge supports 14 connect the plastic panels 11 and 12, and the connection portions therebetween are folded in such a manner that the plastic panels 11 and 12 overlap each other. The plastic panels 11 and 12 are formed of light resin for excellent workability.

Each of the corner hinge supports 13 is connected to the edges of the adjacent plastic panels 11 and 12 in each of the corners, and includes a pair of bracket portions 131 and a hinge portion 133 that are integrated with each other. The pair of bracket portions 131 are formed to have a symmetric shape about the corner, and hingably connected to the hinge portion 133.

The bracket portions 131 have insertion fixing channels 132 which have a U-shaped cross-section and are elongated in a vertical direction such that the edges of the adjacent plastic panels 11 and 12 are inserted and fixed to the insertion fixing channels 132, respectively. The hinge portion 133 forms 90 degrees in a state in which the box 10 is unfolded. For this structure, the bracket portions 131 have stoppers 131*a* formed to face the insertion fixing channels 132, the stoppers 131*a* being met each other when the box 10 is unfolded.

The hinge portion 133 is formed of soft resin which may be easily folded and unfolded, that is, easily deformed to hingably connect the bracket portions 131. The hinge portion 133 may be formed by extrusion molding.

Each of the center hinge supports 14 also includes a pair of bracket portions 141 and a hinge portion 143 to which the bracket portions 141 are hingably connected. The bracket portions 141 and the hinge portion 143 are integrated with each other. Each of the bracket portions 141 have insertion fixing channels 142 which have a U-shaped cross-section and are elongated in a vertical direction such that the edges of the adjacent plastic panels 12 are inserted and fixed to the insertion fixing channels 142, respectively. The hinge portion 143 forms 180 degrees in a state in which the box 10 is unfolded. For this structure, the bracket portions 141 have stoppers 141*a* which meet each other to form 180 degrees in a state where the box is unfolded. Furthermore, the hinge portion 143 is formed by extrusion molding using soft resin, like the hinge portion 133.

Since the corner hinge supports 13 and the center hinge supports 14 are integrally formed by extrusion molding using soft resin, the workability thereof is improved and the price and weight thereof are reduced. However, since the strength is reduced, the corner hinge supports 13 and the center hinge supports 14 are vulnerable to an impact.

FIGS. 3A and 3B illustrate another folding container palette system in which bracket portions and a hinge portion are separated. As illustrated, a corner hinge support 15 and a center hinge support 16 include bracket portions 151 and 161 and hinge portions 153 and 163, respectively, which are formed of a light aluminum material having a relatively high strength and excellent workability, and formed by extrusion molding. Furthermore, the corner hinge support 15 and the center hinge support 16 have coupling grooves 154 and 164 formed in the bracket portions 151 and 161, respectively, and a coupling member 18 inserted and coupled to the coupling grooves 154 and 164 is formed of soft resin which may be repetitively folded and unfolded.

Meanwhile, the insertion fixing channels 152 and 162 to which the plastic panels 11 and 12 are inserted have teeth 155 and 165 formed therein such that the edges of the plastic panels 11 and 12 inserted therein do not come off.

In the above-described conventional folding container palette system, however, relatively thick plastic panels must be used in consideration of the strength of the assembly box, and thick bracket portions must be used like the plastic panels. Therefore, since the respective panels of the assembly box have a large thickness, the volume of the assembly box inevitably increases when the assembly box is folded.

Furthermore, although the teeth are installed to prevent the edges of the plastic panels inserted into the insertion fixing channels from coming off, it was impossible to perfectly prevent the plastic panels from coming off.

In order to complement the problem, the plastic panels 11 and 12 may be fixed to the bracket portions through nails 19 as illustrated in FIG. 4. In this case, however, when the assembly box is folded, the volume of the assembly box may be further increased by the heads of the nails 19. Furthermore, when the nails 19 are used, the damage may be applied to the bracket portions and the plastic panels, thereby degrading a waterproof effect.

SUMMARY

It is, therefore, an object of the present invention to provide a folding assembly box of which the strength is improved while the volume thereof is minimized when the box is folded.

In accordance with an aspect of the present invention, there is provided a folding assembly box including: vertical corner hinge frames disposed in corners of the box, wherein the vertical corner hinge frames are unfolded at an angle to form the respective corners of the box, and are hinged in the opposite direction to the direction where the vertical corner hinge frames are unfolded; first top and bottom horizontal frames disposed to connect upper and lower ends of the vertical corner hinge frames facing each; vertical middle hinge frames disposed between the vertical corner hinge frames facing each other at both sides thereof in parallel to the vertical corner hinge frames, wherein the vertical middle hinge frames are unfolded together with the vertical corner hinge frames at both sides thereof, and hinged in the opposite direction to the opposite direction where the vertical corner hinge frames are unfolded; second top and bottom horizontal frames disposed to connect upper and lower ends of the vertical corner hinge frames facing each other with the vertical middle hinge frame interposed therebetween; first panels, each having side edges inserted between the vertical corner hinge frames facing each other and upper and lower edges inserted between the first top and bottom horizontal frames facing each other; and second panels, each having side edges inserted between the vertical corner hinge frame and the vertical middle hinge frame facing each other and upper and lower edges inserted between the second top and bottom horizontal frames facing each other.

Preferably, the vertical corner and middle hinge frames and the first and second top and bottom horizontal frames have inclined cut ends at both sides thereof, and the cut ends of the vertical corner and middle hinge frames are engaged and coupled to the cut ends of the first and second top and bottom horizontal frames so as to correspond to each other.

Preferably, each of the vertical corner hinge frames includes a hinge portion and symmetrical brackets at both sides of the hinge portion, and each of the brackets includes a hinge coupling portion formed at one end thereof to which the hinge portion is coupled, a clamp insertion portion to which the corner clamp is inserted, and an insertion fixing channel formed at the other end thereof and elongated in a vertical direction such that one side edge of an adjacent second panel is inserted into the insertion fixing channel.

Preferably, each of the vertical middle hinge frames includes a hinge portion and symmetrical brackets at both sides of the hinge portion, and each of the brackets includes a hinge coupling portion formed at one end thereof to which the hinge portion is inserted, a clamp insertion portion to which the corner clamp is inserted, and an insertion fixing channel formed at the other end thereof and elongated in a vertical direction such that one side edge of an adjacent second panel is inserted into the insertion fixing channel.

In accordance with the embodiments of the present invention, the vertical corner frames and the horizontal corner frames are formed in a box shape at the corner of the assembly box when the assembly box is assembled. Therefore, although the panels of the respective surfaces have a small thickness, the strength of the box is not changed. Furthermore, when the box is folded, the thickness and volume thereof may be minimized. Furthermore, since smaller damage is applied to the frames or panels than in the conventional structure, it is possible to increase a waterproof effect.

DETAILED DESCRIPTION

Hereinafter, embodiments of the present invention will be described in detail with reference to the accompanying drawings so that they can be readily implemented by those skilled in the art.

Figure 1:
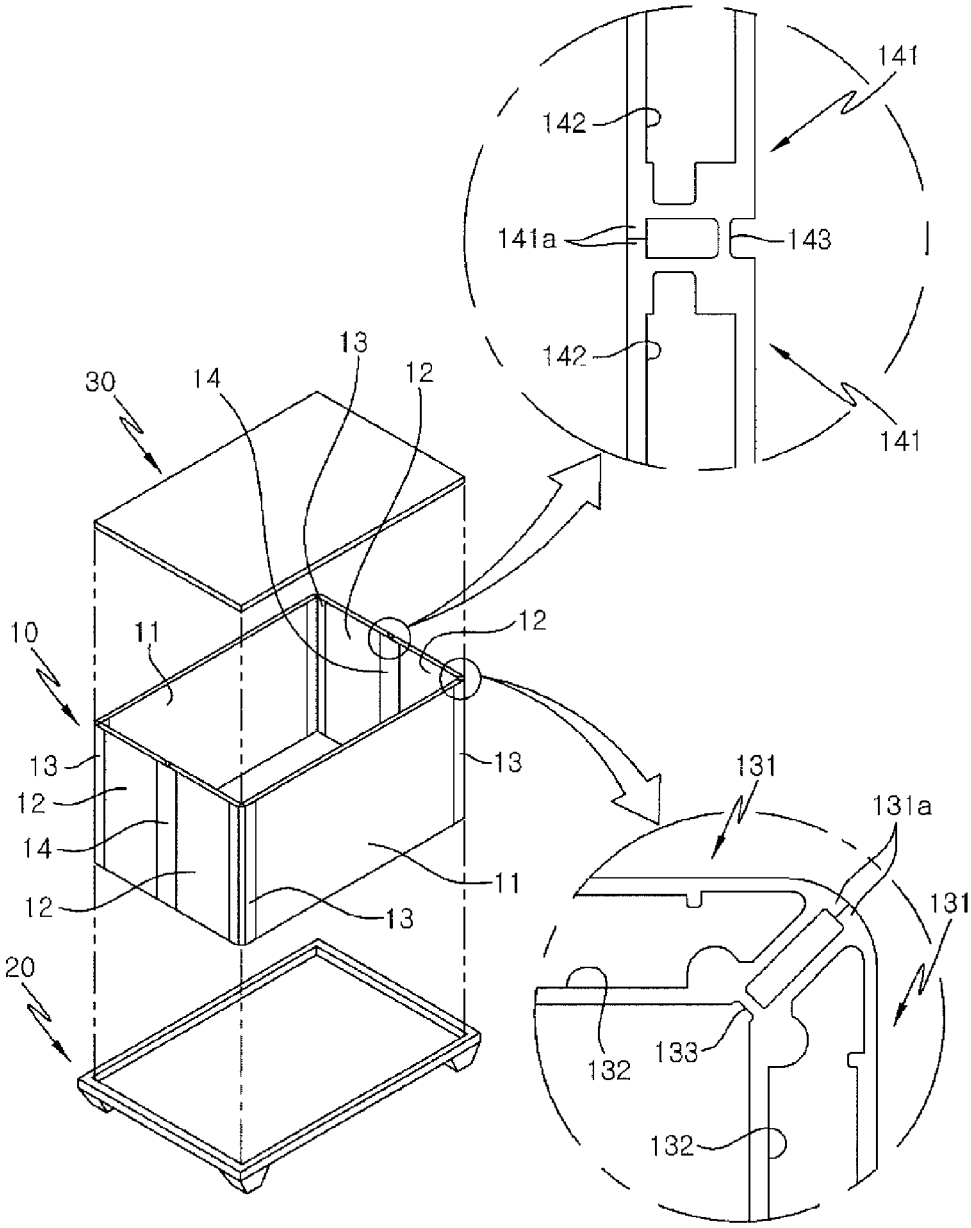
FIG. 1 (PRIOR ART)
FIG. 1 is an exploded perspective view of a conventional folding assembly box for carrying.
Figure 2:
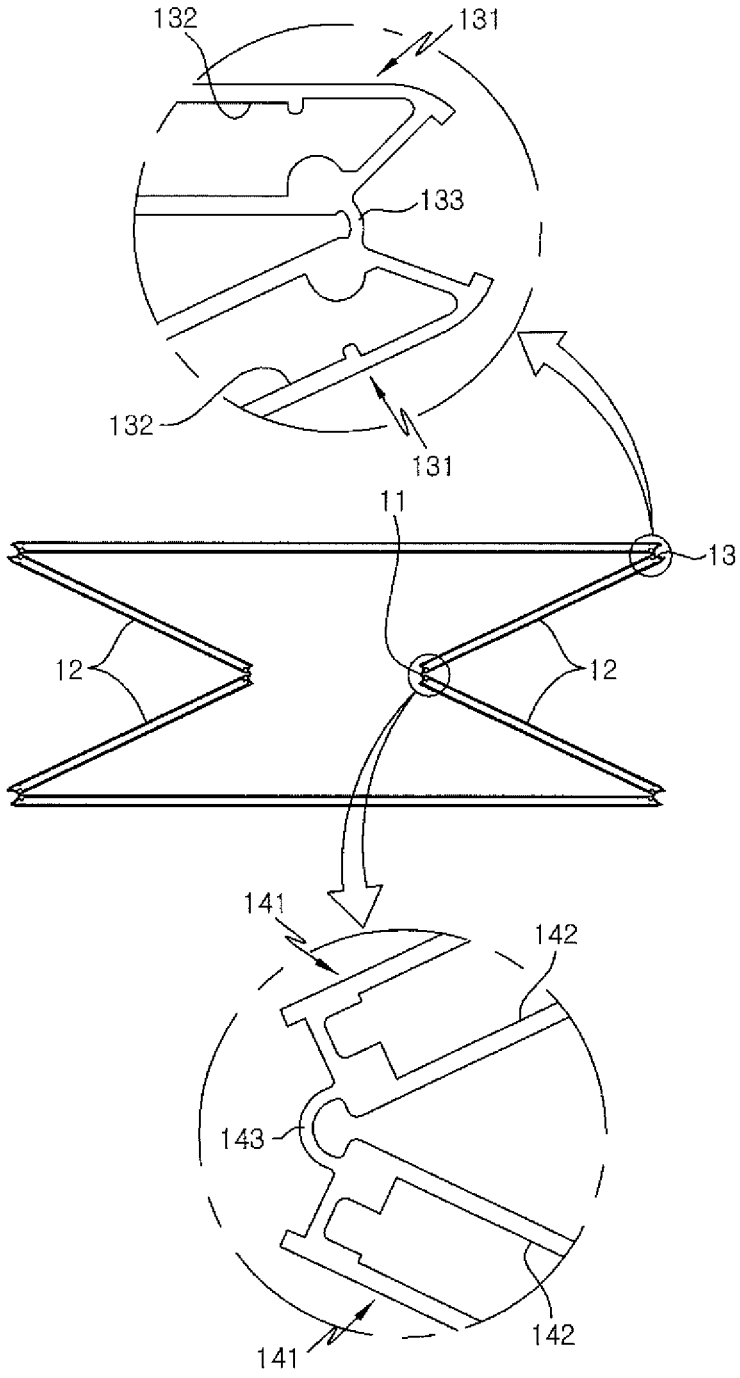
FIG. 2 (PRIOR ART)
FIG. 2 is a cross-sectional view of the folding assembly box of FIG. 1, illustrating a state in which the folding assembly box is folded when carried or stored.
Figure 3A:
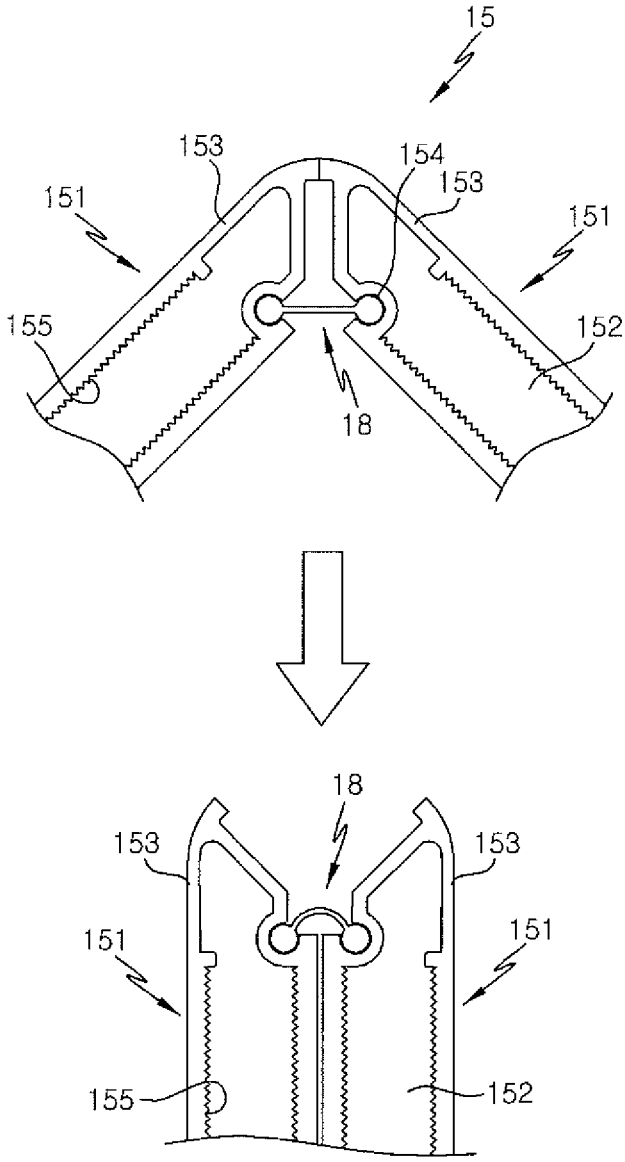
FIG. 3A (PRIOR ART)
FIGS. 3A and 3B are cross-sectional views illustrating other examples of a corner hinge support and a center hinge support of FIG. 1.
Figure 3B:
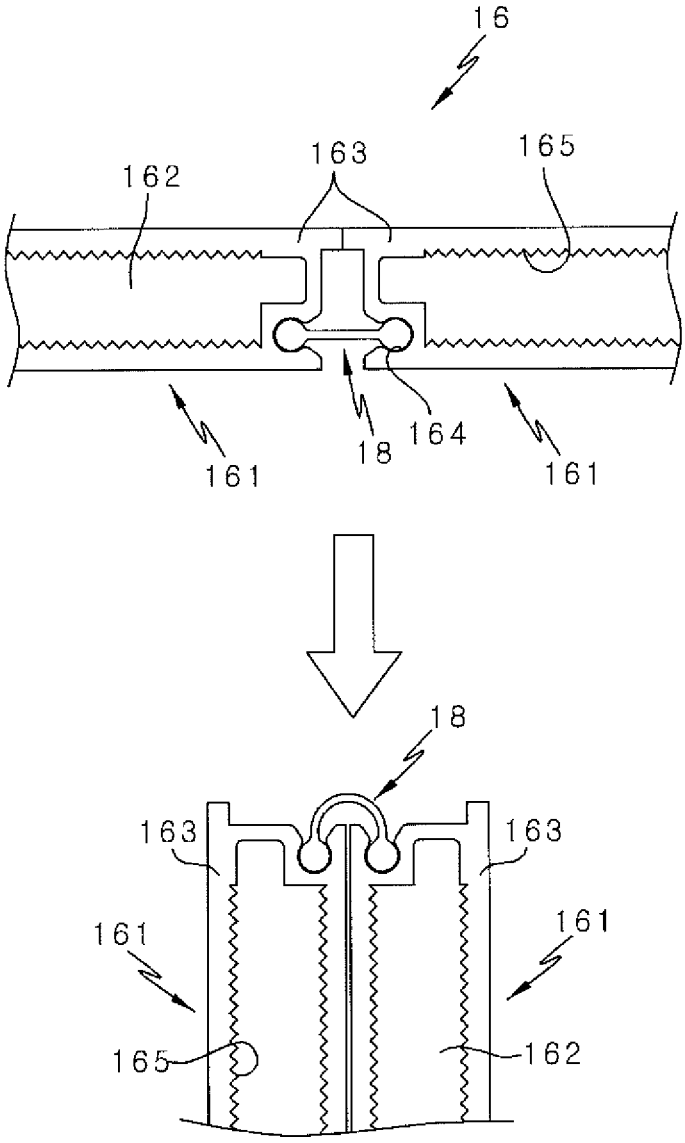
FIG. 3B (PRIOR ART)
Figure 4:
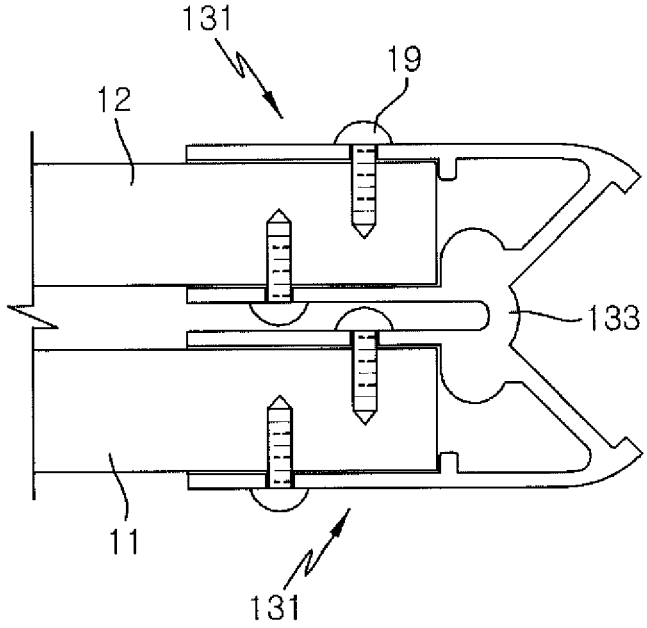
FIG. 4 (PRIOR ART)
FIG. 4 is a diagram illustrating a state in which a plastic panel inserted into an insertion fixing channel of the corner hinge support of FIG. 1 is fixed through a nail.
Figure 5:
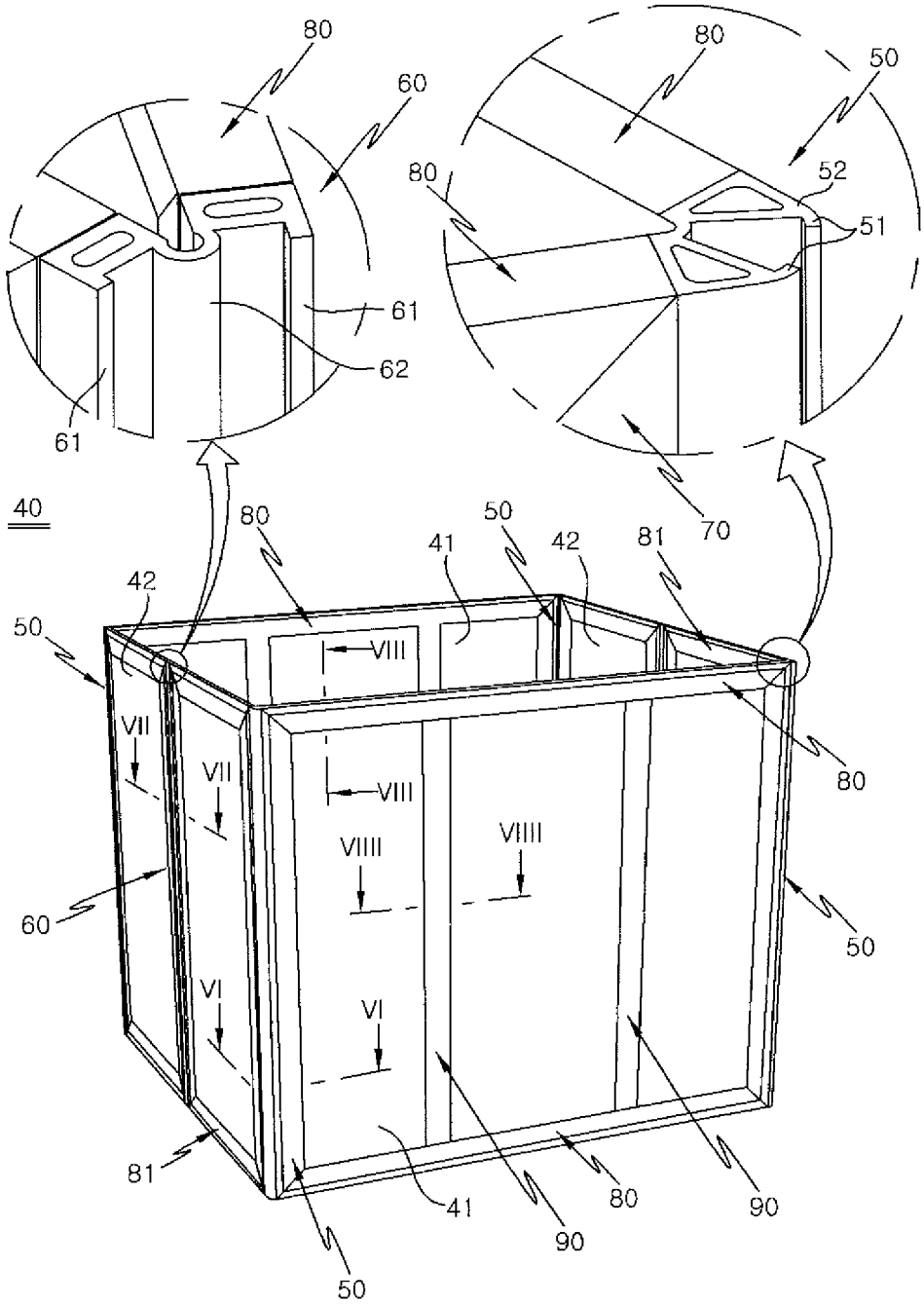
FIG. 5 is a perspective view of a folding assembly box for carrying in accordance with an embodiment of the present invention.

FIG. 5 is a perspective view of a folding assembly box for carrying in accordance with an embodiment of the present invention. Referring to FIG. 5, the folding assembly box 40 for carrying has an opened top and an opened bottom, and includes vertical corner hinge frames 50, first top and bottom horizontal frames 80, second top and bottom horizontal frames 81, vertical middle hinge frames 60, first panels 41, and second panels 42.

The vertical corner hinge frames 50 are disposed in four corners of the folding assembly box 40, respectively. The vertical corner hinge frames 50 are unfolded to form the respective corners of the folding assembly box 40 when the folding assembly box 40 is unfolded. When the folding assembly box 40 is folded for storage, the respective vertical corner hinge frames 50 are hinged in the opposite direction of the direction in which the vertical corner hinge frames 50 are unfolded. The respective vertical corner hinge frames 50 form 90 degrees in a state where the folding assembly box 40 is unfolded, and include stoppers 51 which meet each other to maintain the angle in a state where the folding assembly box 40 is unfolded.

The first top and bottom horizontal frames 80 are disposed to connect upper and lower ends of the vertical corner hinge frames 50 facing each other.

The vertical middle hinge frame 60 is disposed in parallel to the vertical corner hinge frames 50 in the middle between the vertical corner hinge frames 50 facing each other at both sides of the vertical middle hinge frame 60.

The second top and bottom horizontal frames 81 have a length equal to or smaller than the first top and bottom horizontal frames 80, and are disposed to connect upper and lower ends of the vertical corner hinge frames 50 facing each other with the vertical middle hinge frame 60 interposed therebetween.

The vertical middle hinge frame 60 is unfolded together with the vertical corner hinge frames 50 when the folding assembly box 40 is unfolded. When the folding assembly box 40 is folded for storage, the vertical middle hinge frame 60 is hinged in the opposite direction of the direction where the vertical corner hinge frames 50 are hinged. The vertical middle hinge frame 60 forms 180 degrees in a state where the folding assembly box 40 is unfolded, and includes stoppers 61 meeting each other to maintain the angle.

Depending on the hinge direction of the vertical middle hinge frame 60, the vertical middle hinge frame 60 may be hinged toward the internal space of the folding assembly box 40 or hinged in the opposite direction. However, considering the size of the box when the box is folded, it is more desirable that the vertical middle hinge frame 60 is hinged toward the internal space of the folding assembly box than that the vertical middle hinge frame 60 is hinged in the opposite direction.

The first panel 41 has both side edges inserted between the vertical corner hinge frames 50 facing each other and upper and lower edges inserted between the horizontal frames 80 facing each other. The second panel 42 has both side edges inserted between the vertical corner hinge frame 50 and the vertical middle hinge frame 60 facing each other and upper and lower edges inserted between the second top and bottom horizontal frames 81 facing each other. The first and second panels 41 and 42 are formed of plastic resin having a small weight and excellent workability.

Figure 10:
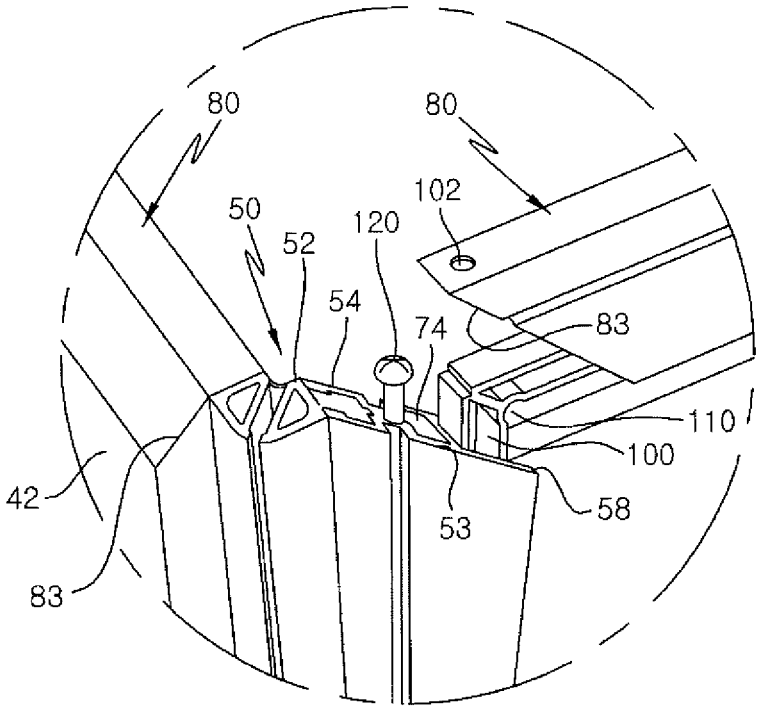
FIG. 10 is a partially exploded perspective view illustrating a state in which a vertical corner hinge frame of FIG. 6 and a horizontal frame of FIG. 8 are assembled.
Figure 11:
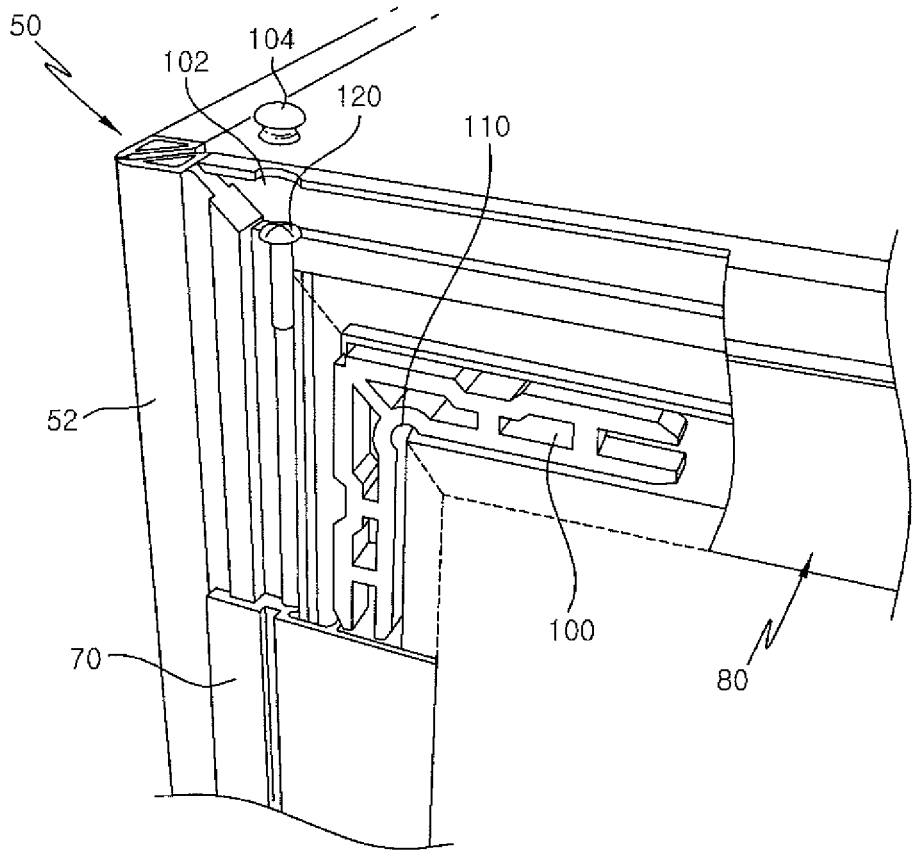
FIG. 11 is a diagram illustrating a state in which a corner clamp of FIG. 10 is assembled.

Furthermore, referring to FIGS. 10 and 11, the vertical corner and middle frames 50 and 60 and the horizontal frames 80 and 81 have included cut ends 53 and 83 corresponding to each other at both sides thereof. The included cut ends are engaged and coupled to form the frame of the assembly box, like a sash structure of a window or picture frame. The plastic panels 41 and 42 are inserted between the frames forming the assembly box.

Furthermore, the folding assembly box for carrying further includes a plurality of vertical reinforcement frames 90 which are extended between the first top and bottom horizontal frames 80 and support the first plastic panels 41 so as to reinforce the overall strength of the folding assembly box 40.

In this embodiment of the present invention, FIG. 5 illustrates that two vertical reinforcement frames 90 are disposed to improve the strength of the folding assembly box. However, the number of vertical reinforcement frames may be properly selected instead of two. Therefore, although the first and second panels have a small thickness, the strength of the folding assembly box is improved by the vertical reinforcement frames 90. Furthermore, when the vertical corner hinge frames 50 and the vertical middle hinge frames 60 of the folding assembly box are folded in such a manner that the plastic panels 42 overlap each other, the volume of the folding assembly box 40 may be reduced when the folding assembly box 40 is carried or stored.

The folding assembly box 40 further includes a corner clamp 100 which fixes the vertical corner hinge frame 50 and the horizontal frame 80 and will be described below with reference to FIGS. 10 and 11.

Figure 6:
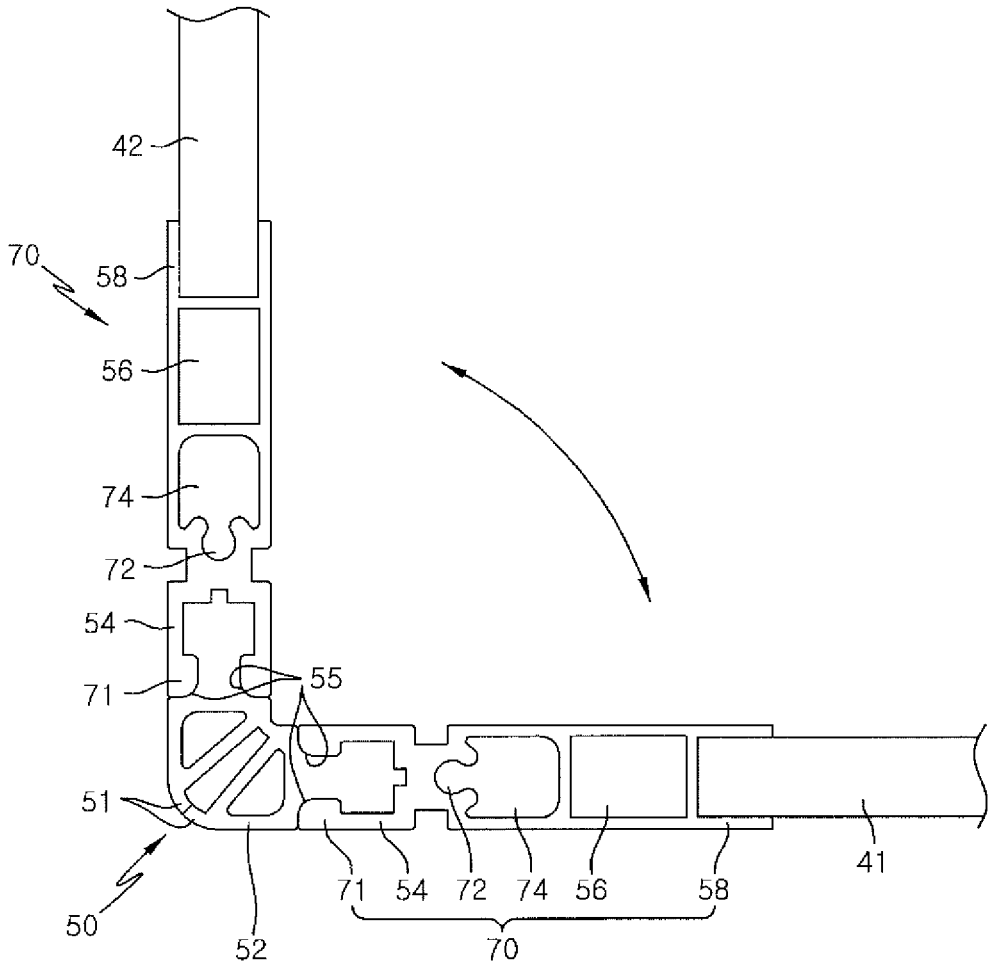
FIG. 6 is a cross-sectional view taken along line VI-VI of FIG. 5.

FIG. 6 illustrates the structure of the vertical corner hinge frame 50 in detail. Referring to FIG. 6, the vertical corner hinge frame 50 includes a hinge portion 52 and symmetrical brackets 70 at both sides of the hinge portion 52. The hinge portion 52 includes extended ends each having coupling grooves 55 at both sides thereof. Each of the brackets 70 includes a hinge coupling portion 54 formed at one end thereof, a clamp insertion portion 56, and an insertion fixing channel 58 formed at the other end thereof. The hinge coupling portion 54 is coupled to the hinge portion 52. The corner clamp 100 is inserted into the clamp insertion portion 56. The insertion fixing channel 58 is elongated in a vertical direction such that the edge of the plastic panel 41 or 42 is inserted into the insertion fixing channel 58. Furthermore, the bracket 70 includes a screw coupling portion 74 which is formed between the hinge coupling portion 54 and the clamp insertion portion 56 and has a screw groove 72 formed to screw the vertical corner hinge frame 50 and the first top and bottom horizontal frames 80 to each other. The hinge coupling portion 54 has coupling protrusions 71 of which end surfaces are rounded. As the coupling protrusions 71 are coupled to the coupling grooves 55 of the hinge portion 52, the bracket 70 is reliably coupled to the hinge portion 52. The hinge portion 52 may be formed of soft resin such that the brackets 70 at both sides of the hinge portion 52 are hingably folded and unfolded about the hinge portion 52. The hinge portion 52 may be formed by extrusion molding. The bracket 70 may be formed of aluminum, polypropylene, or polyvinyl chloride (PVC), in order to form the frame of the folding assembly box.

Figure 7:
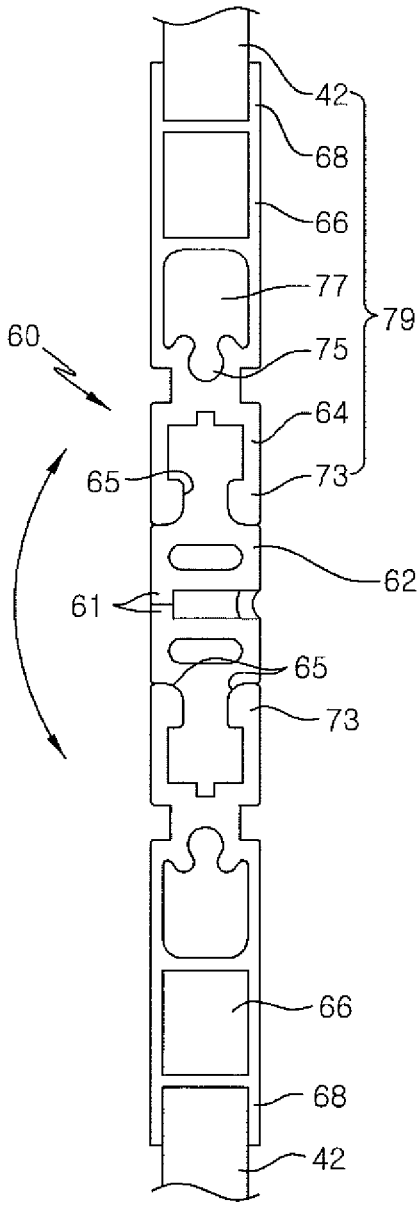
FIG. 7 is a cross-sectional view taken along line VII-VII of FIG. 5.

Similarly, referring to FIG. 7, the vertical middle hinge frame 60 includes a hinge portion 62 and symmetrical brackets 79 formed at both sides of the hinge portion 62. The hinge portion 62 includes extended ends each having coupling grooves 65 formed at both sides thereof. Each of the brackets 79 includes a hinge coupling portion 64 formed at one end thereof, a clamp insertion portion 66, and an insertion fixing channel 68 formed at the other end thereof. The hinge coupling portion 64 is coupled to the hinge portion 62. The corner clamp 100 is inserted into the clamp insertion portion 66. The insertion fixing channel 68 is elongated in a vertical direction such that the edge of the plastic panel 42 is inserted into the insertion fixing channel 68. Furthermore, the bracket 79 includes a screw coupling portion 77 which is formed between the hinge portion 64 and the clamp insertion portion 66 and has a screw groove 75 formed to screw the vertical middle hinge frame 60 and the second top or bottom horizontal frame 81 to each other. The hinge coupling portion 64 has coupling protrusions 73 of which the end surfaces are rounded. As the coupling protrusions 73 are coupled to the coupling grooves 65 of the hinge portion 62, the bracket 79 is reliably coupled to the hinge portion 62.

The hinge portion 62 may be formed of soft resin such that the brackets 79 at both sides of the hinge portion 62 are hingably folded and unfolded about the hinge portion 62. The hinge portion 62 may be formed by extrusion molding. The bracket 79 may be formed of aluminum, polypropylene, or PVC, in order to form the frame of the folding assembly box.

Figure 8:
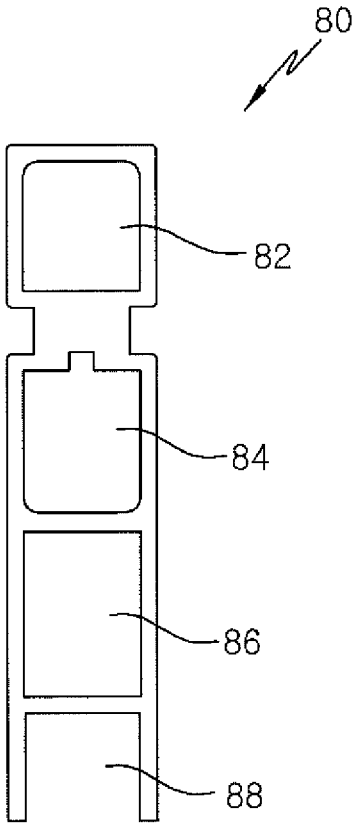
FIG. 8 is a cross-sectional view taken along line VIII-VIII of FIG. 5.

FIG. 8 illustrates the structure of the first and second horizontal frames 80 in detail. Referring to FIG. 8, each of the horizontal frames 80 includes a frame coupling portion 82, a screw coupling portion 84, a clamp insertion portion 86, and an insertion fixing channel 88. The frame coupling portion 82 has an end corresponding to the hinge coupling portion 52 or 62 of the vertical corner hinge frame 50 or the vertical middle hinge frame 60. The screw coupling portion 84 corresponds to the screw coupling portion 74 of the vertical corner hinge frame 50 or the vertical intermediate hinge frame 60. The corner clamp 100 is inserted into the clamp insertion portion 86. The insertion fixing channel 88 corresponds to the insertion fixing channel 58 or 68 of the vertical corner hinge frame 50 or the vertical middle hinge frame 60, and the plastic panel 41 or 42 is inserted into the insertion fixing channel 88.

FIGS. 10 and 11 are partially exploded perspective views illustrating a state in which the vertical corner hinge frame of FIG. 6 and the first horizontal frame of FIG. 8 are assembled. Referring to FIGS. 10 and 11, the corner clamp 100 is bent at 90 degrees about a central groove 110 thereof. As both ends of the clamp 100 are inserted into the clamp insertion portions 56 and 86, respectively, the vertical corner hinge frame 50 and the horizontal frame 80 are reliably fixed to each other. The corner clamp 100 may be formed of aluminum, in order to implement the stability between a load and the frames.

FIG. 11 illustrates a state in which the corner clamp is assembled. Referring to FIG. 11, a screw 120 is coupled to the screw groove 72 of the vertical corner hinge frame 50 or the vertical middle hinge frame 60 through a screw coupling hole 102 formed in the horizontal frame 80 or 81 in a state where the inclined cut end having a slope of 45 degrees of the vertical corner hinge frame 50 or the vertical middle hinge frame 60 is engaged and coupled to the inclined cut end of the first and second horizontal frame 80 or 81 such that the respective frames are further reliably maintained. In FIG. 11, reference numeral 104 represents a cover inserted into the screw coupling hole 102.

Figure 9:
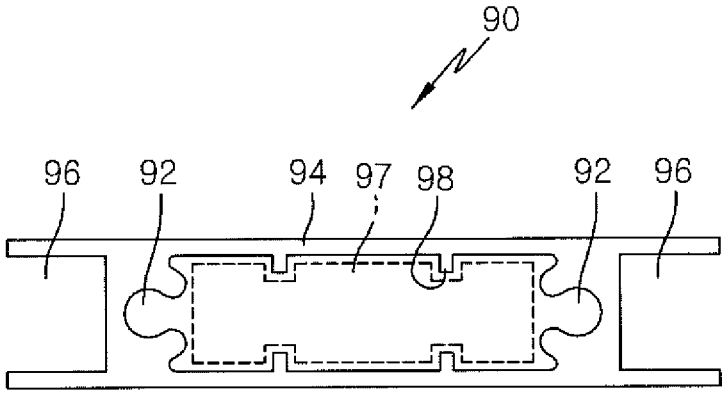
FIG. 9 is a cross-sectional view taken along line VIII-VIII of FIG. 5.

FIG. 9 illustrates the detailed structure of the vertical reinforcement frame 90. Referring to FIG. 9, the vertical reinforcement frame 90 includes a screw coupling portion 94 and an insertion fixing channel 96. The screw coupling portion 94 has screw grooves 92 formed at both sides thereof, and the insertion fixing channel 96 is elongated in a vertical direction such that the edges of the adjacent plastic panels 41 outside the screw grooves 92 are inserted into the screw grooves 92. The vertical reinforcement frame 90 is coupled to the horizontal frame 80 through a bolt (not illustrated). When the bolt is coupled to the screw groove 92 through the horizontal frame 80, the horizontal frame 80 and the vertical reinforcement frame 90 are fastened while pulling each other. Therefore, the horizontal frame 80 may not maintain level. In order to prevent such a problem, a support member 97 is inserted into the screw coupling portion 94 so as to vertically support the vertical reinforcement frame 90. The vertical reinforcement frame 90 includes a plurality of guide protrusions 98 formed on the inner wall of the screw coupling portion 94 so as to guide the insertion of the support member 97.

In the above-described folding assembly box in accordance with the embodiment of the present invention, the vertical corner hinge frame 50, the vertical middle hinge frame 60, and the first and second horizontal frames 80 and 81 are engaged with each other through the included cut ends thereof, like a sash structure of a window or picture frame, such that the panels 41 and 42 are inserted into the engaged frames and reliably fixed by the respective frames. Accordingly, although the panels are formed to have a smaller thickness relative to the conventional panel, the folding assembly box has no problems in strength. Furthermore, when the folding assembly box is folded, the volume and thickness of the folding assembly box can be reduced.

Furthermore, the corner clamp 100 is coupled inside the horizontal frame 80 which is coupled to the vertical corner hinge frame 50 or the vertical middle hinge frame 60 while forming 90 degrees therebetween, and the screw 120 is coupled to the screw groove 72 formed in the vertical corner hinge frame 50 through the screw coupling hole 102 formed in the horizontal frame 80. Therefore, the panels and the frames coupled to the panels are not damaged, but the box has a strong frame. Furthermore, moisture may be blocked from outside to accomplish an excellent waterproof effect.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A folding assembly box comprising:

vertical corner hinge frames disposed in corners of the box, wherein the vertical corner hinge frames are unfolded at an angle to form the respective corners of the box, and are hinged in an opposite direction to a direction where the vertical corner hinge frames are unfolded;

first top and bottom horizontal frames disposed to connect upper and lower ends of the vertical corner hinge frames facing each;

vertical middle hinge frames disposed between the vertical corner hinge frames facing each other at both sides thereof in parallel to the vertical corner hinge frames, wherein the vertical middle hinge frames are unfolded together with the vertical corner hinge frames at both sides thereof, and hinged in an opposite direction to a direction where the vertical corner hinge frames are hinged;

second top and bottom horizontal frames disposed to connect upper and lower ends of the vertical corner hinge frames facing each other with the vertical middle hinge frame interposed therebetween;

first panels, each having side edges inserted between the vertical corner hinge frames facing each other and upper and lower edges inserted between the first top and bottom horizontal frames facing each other;

second panels, each having side edges inserted between the vertical corner hinge frame and the vertical middle hinge frame facing each other and upper and lower edges inserted between the second top and bottom horizontal frames facing each other, and a first corner clamp for fixing the vertical corner hinge frame and one of the first top and bottom horizontal frames and the second top and bottom horizontal frames, and a second corner clamp for fixing the vertical middle hinge frame and the second top and bottom horizontal frames, wherein the vertical corner and middle hinge frames and the first and second top and bottom horizontal frames have inclined cut ends at both sides thereof, and the cut ends of the vertical corner and middle hinge frames are engaged and coupled to the cut ends of the first and second top and bottom horizontal frames so as to correspond to each other.

2. The folding assembly box of claim 1, where each of the vertical corner hinge frames includes a hinge portion and symmetrical brackets at both sides of the hinge portion, and each of the brackets includes a hinge coupling portion formed at one end thereof to which the hinge portion is coupled, a clamp insertion portion to which the first corner clamp is inserted, and an insertion fixing channel formed at the other end thereof and elongated in a vertical direction such that the side edge of one of the first panel and the second panel is inserted into the insertion fixing channel.

3. The folding assembly box of claim 1, wherein each of the vertical middle hinge frames includes a hinge portion and symmetrical brackets at both sides of the hinge portion, and each of the brackets includes a hinge coupling portion formed at one end thereof to which the hinge portion is inserted, a clamp insertion portion to which the second corner clamp is inserted, and an insertion fixing channel formed at the other end thereof and elongated in a vertical direction such that the side edge of the second panel is inserted into the insertion fixing channel.

4. The folding assembly box of claim 2, wherein the vertical corner hinge frame further includes a screw coupling portion formed between the hinge coupling portion and the clamp insertion portion and having a screw groove formed to screw the vertical corner hinge frame and the first top and bottom horizontal frames to each other.

5. The folding assembly box of claim 3, wherein the vertical middle hinge frame further includes a screw coupling portion formed between the hinge coupling portion and the clamp insertion portion and having a screw groove formed to screw the vertical middle hinge frame and the second top and bottom horizontal frames to each other.

6. The folding assembly box of claim 2, wherein the hinge coupling portion further includes coupling protrusions of which end surfaces are rounded to be coupled to the hinge portion.

7. The folding assembly box of claim 1, further including a vertical reinforcement frame connected between the first top and bottom horizontal frames so as to the support the first panel.

8. The folding assembly box of claim 7, wherein the vertical reinforcement frame includes a screw coupling portion having screw grooves formed at both sides thereof such that the screw coupling portion is screwed to the first top and bottom horizontal frames and an insertion fixing channel elongated in a vertical direction such that an edge of one of the adjacent first panels outside the screw grooves is inserted into the insertion fixing channel.

9. The folding assembly box of claim 3, wherein the hinge coupling portion further includes coupling protrusions of which end surfaces are rounded to be coupled to the hinge portion.

* * * * *